US005207276A

United States Patent [19]

Scofield

[11] Patent Number: 5,207,276

[45] Date of Patent: May 4, 1993

[54] WIRE-SENSORED FIRE EXTINGUISHER WITH FAULT-MONITORING CONTROL SYSTEM

[75] Inventor: William A. Scofield, Clifton, N.J.

[73] Assignee: Pem All Fire Extinguisher Corp., Cranford, N.J.

[21] Appl. No.: 831,266

[22] Filed: Feb. 4, 1992

Related U.S. Application Data

[63] Continuation-in-part of Ser. No. 691,316, Apr. 25, 1991.

[51] Int. Cl.[5] ..... A62C 37/40

[52] U.S. Cl. ..... 169/61; 169/65

[58] Field of Search ..... 169/65, DIG. 3, 61, 169/26, 42

[56] References Cited

U.S. PATENT DOCUMENTS

| | | | |
|---|---|---|---|
| 2,585,039 | 2/1952 | Rooke | 169/26 X |
| 3,653,443 | 4/1972 | Dockery | 169/61 |
| 3,825,766 | 7/1974 | Connor et al. | 169/61 X |
| 4,062,112 | 12/1977 | Lake | 30/228 |
| 4,101,887 | 7/1978 | Osborne | 169/61 X |
| 4,356,870 | 11/1982 | Gaylord et al. | 169/65 |
| 4,814,766 | 3/1989 | Domingue | 169/61 X |
| 4,830,116 | 5/1989 | Walden et al. | 169/65 |
| 4,834,188 | 5/1989 | Silverman | 169/65 |
| 4,854,389 | 8/1989 | Warren et al. | 169/61 X |
| 4,905,765 | 3/1990 | Hein | 169/26 X |

FOREIGN PATENT DOCUMENTS

| | | | |
|---|---|---|---|
| 266275 | 3/1989 | German Democratic Rep. | 169/61 |
| 1351616 | 11/1987 | U.S.S.R. | 169/61 |

*Primary Examiner*—Russell D. Stormer
*Assistant Examiner*—Gary C. Hoge
*Attorney, Agent, or Firm*—Rohm & Monsanto

[57] ABSTRACT

A range hood positioned above a cooking range employs a continuous heat sensor system which includes twisted wires which are separated from one another by an insulator which is formed of a material which melts at a predetermined temperature. The wires carry a supervisory current which is monitored continuously. When the magnitude of the current is increased, such as by the creation of a short-circuit condition as would be caused by the presence of a fire, an actuation signal is issued to an actuator, which may include an explosive squib. The explosive squib releases a tension wire which holds a discharge valve in a closed position, permitting a fire suppressant fluid to be discharged from a supply tank. Monitor circuitry ensures that open-circuit or short-circuit faults do not disable the functioning of the actuation system. Multi-condition fault indicators alert the user visually and audibly of system faults.

19 Claims, 3 Drawing Sheets

WIRE-SENSORED FIRE EXTINGUISHER WITH FAULT-MONITORING CONTROL SYSTEM

RELATIONSHIP TO OTHER APPLICATION(S)

This application is a continuation-in-part of U.S. patent Ser. No. 07/691,316, which was filed in the U.S. Patent and Trademark Office on Apr. 25, 1991 and assigned to the same assignee as herein, the disclosure of which is incorporated herein by reference.

BACKGROUND OF THE INVENTION

This invention relates generally to fire extinguisher systems, and more particularly, to a fire extinguisher system which is deployed as a hood over a range top, and which can determine the presence of a fire continuously along a predetermined path so as not to be limited to discreet sensing zones.

For over three decades, various arrangements of range hood fire protection systems have been employed in commercial and residential environments. Generally, these known systems are characterized by the application of a tensile force on a cable which holds a fire extinguisher discharge valve in a closed position against a force applied by a resilient element, such as a spring, which would tend to open the discharge valve. In these known systems, the cable is segmented and provided with fusible links connecting the various segments to one another. Additionally, cable is trained within the hood along a plurality of cable supports, whereby the fusible links are advantageously disposed at strategic locations, such as directly over a burner of the range top.

In the event of a fire, the heat which builds up under the hood will melt the fusible link so as to release the tension on the segmented cable. Such release of the tension permits the valve to be urged into the open position, by operation of the resilient biasing element.

There are, of course, a variety of problems associated with conventional fusible link systems. One major problem is the great complexity and difficulty associated with installing one of these known systems. During installation, the cable segments must be cut to precise lengths, or otherwise the fusible links will not be located in the appropriate regions. This, of course, is essential to a proper installation since mislocation of one or more of the fusible links will result in a fire hazard. In addition, the apparatus must be configured so that there is a sufficient length of cable between each fusible link and its nearest cable support, so that, upon the release of the cable at the fusible link, there is a sufficient length of cable before every cable support such that the discharged valve can be release. In other words, placement of a fusible link too close to the cable support will cause S-hooks or cable ties to bind at the cable support before the discharge valve has been moved sufficiently to enter a fully open state. Clearly, fusible link systems require great skill in their installation.

A still further problem which is associated with the installation of fusible link fire extinguisher systems is that, particularly in installations where the chemical tank is located remotely, possibly in another room, the cable must be trained along and through walls, and steps must be taken to ensure that the cable does not bind anywhere therealong. Of course, throughout its traverse, the cable must provide the tensile force which is required to prevent the biasing member from urging the discharge valve into the open position. Of course, if the cable binds anywhere along its path, the discharge valve can be retained in the closed position, notwithstanding that one or more of the fusible elements has melted. The results, of course, could be disastrous.

Another problem with fusible link systems is that they are not readily adaptable to changes in the configuration of the burners of the range top, without undergoing essentially a complete cable reinstallation process. More specifically, if it is desired to change the specific location of the region desired to be protected from a fire hazard under the protective hood, it is necessary in conventional fusible link systems that the entire fusible link and cable system be removed and resized so that the fusible links can be relocated. Of course, if it is necessary to protect an area which was not traversed over by the cable, significant modifications, such as the inclusion of new cable supports, will be required. Such cable supports must be structurally quite sound as they are generally required to bear the tensile force in the cable.

It is, therefore, an object of this invention to provide a simple and reliable residential range hood fire extinguisher system which can easily be installed without requiring extensive experience or expertise.

It is another object of this invention to provide a range hood fire extinguisher system which affords heat responsive sensing over a continuous predetermined region.

It is also an object of this invention to provide a fire extinguisher system which continuously monitors itself for the development of fault conditions which would render the system inoperative.

It is a further object of this invention to provide a fire extinguisher system which can easily trigger discharge of an extinguisher material from a remote location without the need to extend lengthy cables under tension.

It is additionally an object of this invention to provide a range hood fire protection system which can easily be reconfigured, as desired.

It is a yet further object of this invention to provide a fire extinguisher system which provides a visual indication of the existence of a fault condition.

It is also another object of this invention to provide a range hood fire extinguisher system which does not require the complicated mechanical support arrangements provided for segment cable and fusible link systems.

It is yet an additional object of this invention to provide a range hood fire extinguisher system which is actuatable with only a small amount of electrical current, whereby protection is achieved without requiring the electrical mains to be operable at all times.

It is still another object of this invention to provide a range hood fire extinguisher system which is easy to maintain and test for proper operation, and does not have associated with it the hazards of a tensioned cable.

It is a yet further object of this invention to provide a range hood fire extinguisher system which is easily adapted for different fire hazard temperatures.

It is also a further object of this invention to provide a simple and inexpensive range hood fire extinguisher system which does not require the strong cable supports of known arrangements.

SUMMARY OF THE INVENTION

The foregoing and other objects are achieved by this invention which provides a systems for extinguishing a fire which may occur within a predetermined region. In accordance with the invention, the system is provided with a supply of pressurized fire suppressant material for extinguishing the fire. An actuatable discharge arrangement releases the pressurized fire suppressant material upon its being actuated. An electrical sensor is arranged in the vicinity of the predetermined region, the sensor having an electrical characteristic which changes in response to heat in the protected region. Additionally, a sensor monitor monitors the electrical characteristic of the sensor. A trigger which is responsive to the sensor monitor actuates the actuatable discharge means.

In accordance with a specific illustrative embodiment of the invention, first and second conducts are provided for carrying a relatively small supervisory electrical current. The first and second conductors are separated by a conductor separator which has a predetermined heat response characteristic. The conductor separator maintains the first and second conductors electrically insulated from one another when the temperature within the protected region is below a predetermined temperature. However, when the predetermined temperature is exceeded, the electrical conductors are brought into electrical communication with one another to complete an electrical circuit with a low, or substantially short circuit, electrical impedance across the first and second conductors, and a corresponding increase in the magnitude of the supervisory electrical current. The increase in the supervisory electrical current is sufficient to cause a system for discharging a fire suppressant material to be activated.

In a further embodiment of the invention, at least one of the conductors is covered by an electrically insulating sleeve which is arranged to surround at least a portion of the conductor. The electrically insulating sleeve is formed of a material which melts when the predetermined current is exceeded. More specifically, the conductors are arranged on either side of the electrically insulating material, illustratively by wrapping one conductor around the other with the insulator therebetween, such that when the heat of the fire hazard causes the temperature to exceed a predetermined value, the insulating material melts away permitting the electrical communication between the conductors and the corresponding increase in the supervisory electrical current.

In one highly advantageous embodiment of the invention, a hood, such as a range hood, is arranged to overlie the predetermined region. The hood is provided with a top wall, first and second side walls, and a front wall. The first and second conductors are disposed substantially within the hood.

The aforementioned system is, in certain embodiments, provided with a discharge control system which is connected between the supply coupling, illustratively in the form of a hose or pipe coupled to a nozzle assembly arranged within the optional hood, and the supply of fire suppressant material. The discharge control arrangement controls the delivery of the fire suppressant material in response to the magnitude of the supervisory electric current. The particular state of the discharge control system is responsive to whether the magnitude of the supervisory current is above or below the electrical threshold characteristic. Consequently, the electrical threshold characteristic of the discharge control system is intermediate of the nominal supervisory electrical current value, and a high supervisory electrical current value which flows through the short-circuit-like condition produced when the first and second conductors are brought into electrical communication with one another, as will be the case after the insulating sleeve has melted away in response to the heat of a fire.

In a further embodiment, the actuatable discharge system includes an explosive device, such as a commercially available squib, which has an electrical input for receiving the electrical triggering signal. In response to the electrical triggering signal, an explosive charge, which is contained within a chamber, urges a piston to cut a cable or pin which retains a tensile force which prevents discharge of the fire suppressant material. However, the release of the tensile force permits a valve affixed to the supply of fire suppressant material to be urged into an open state in response to an unrestrained resilient biasing element, such as a spring.

As indicated, the valve has closed and opened states, and is connected to the supply coupling arrangement. An operator is coupled to the valve, which operator may be in the form of a lever having first and second positions which correspond to the closed and opened states, respectively. A biasing element, which, as indicated, may be a spring, applies a force to the operator which tends to urge same to the second position. However, a tension member which is coupled to the operator applies a force thereto in opposition to the biasing element, so as to maintain the operator in the first position. An activator, which may be in the form of a wire cutter, is responsive to the current flowing through the sensor wire and will cut the tension member so as to release same, in response to the sensor achieving an activated state.

In addition to the discharge of the fire suppressant material which will occur when the sensor enters the activated state, an alarm can be provided in certain embodiments to produce a perceptible indication when a fault indication is detected in the actuatable discharge system. Any of several known alarm indicators can be employed in combination with the practice of the invention. Additionally, the system may be provided with a battery and battery charging circuitry, which will provide energy for maintaining the system in vigilance of the fire hazard, during periods that power from the mains is unavailable. The battery back-up system includes a charger monitor coupled to the main electrical supply and the alarm for providing a perceptible indication when a fault condition is detected in the electrical supply. Additionally, a battery charger is coupled to the alarm for providing a perceptible indication when a fault condition is detected in the charge state of the battery back-up.

In accordance with a further system aspect of the invention, a system for producing an activation signal responsive to the presence of a fire which may occur within a protected region employs a hood which is arranged to overlie the protected region. The hood has a top wall, first and second side walls, and a front wall. As previously indicated, first and second conductors are arranged to carry a supervisory electrical signal, the first and second conductors being arranged and supported beneath the hood so as to be intermediate of the hood and the protected region. A conductor separation system having a predetermined heat response characteristic is provided, whereby the first and second conductors are maintained electrically insulated from one another when the ambient temperature is below a predetermined temperature value. The conductors are brought into electrical communication with one another when the predetermined temperature is exceeded. This results in a substantially short circuit, low impedance condition across the first and second conductors, and a corresponding increase in the magnitude of the supervisory electrical current, as previously mentioned. Of course, the electrical impedance characteristic of the electrical device is substantially greater than the low impedance which results when the first and second conductors communicate with one another. The conductors are coupled to a current sensor which has an electrical input for receiving the supervisory electrical current. The sensor has activated and inactivated states responsive to an activation current threshold characteristic which is intermediate of a low supervisory electrical current value which flows through the electrical device when no fire is detected, and a high supervisory electrical current value which flows through the low impedance condition indicative of the presence of high heat. An activator arrangement issues an electric signal in response to the sensor monitor. Additionally, and activator monitor detects whether a fault condition is present in the activator arrangement.

In accordance with a method aspect of the invention, a for protecting a predetermined zone includes the steps of propagating a supervisory current through at least first and second conductors arranged in the vicinity of the predetermined region;

urging the first and second conductors into electrical communication with one another when a temperature within the predetermined region exceeds a predetermined temperature, whereby the first and second conductors achieve a low impedance condition;

monitoring the magnitude of a supervisory current flowing through the first and second conductors;

issuing an activation signal to an actuator in response to a change in the magnitude of the supervisory current; and triggering a discharge of a fire suppressant material in response to the activation signal.

In a further embodiment of the method aspect of the invention, there is further provided the step of fault monitoring the actuator for detecting open-circuit and short-circuit faults therein. The step of triggering includes the further step of igniting an explosive material in response to the activation signal.

BRIEF DESCRIPTION OF THE DRAWING

Comprehension of the invention is facilitated by reading the following detailed description, in conjunction with the annexed drawing, in which.

DETAILED DESCRIPTION

Figure 1:
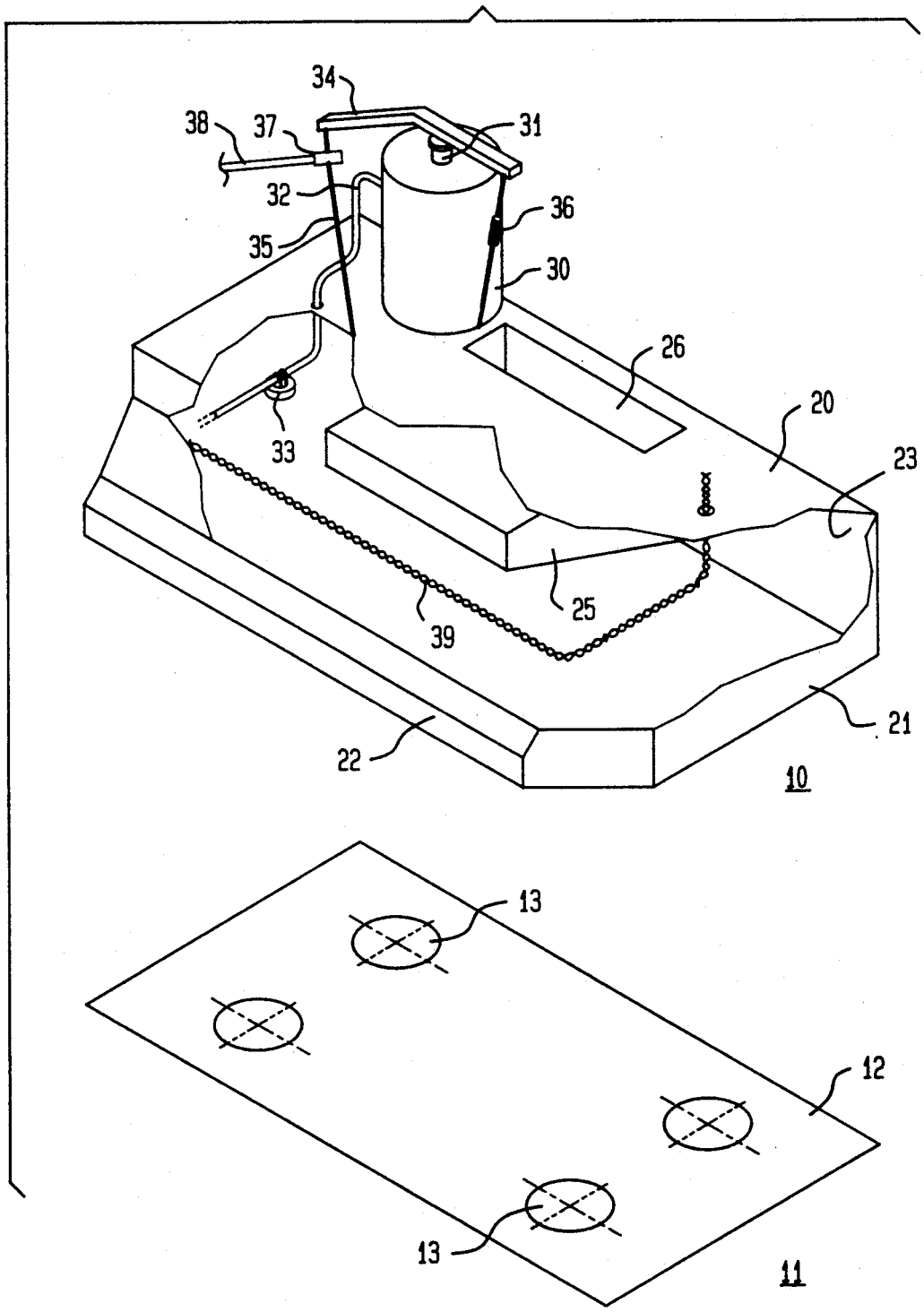
FIG. 1 is a partially cut-away isometric presentation of a specific illustrative embodiment of the invention.

FIG. 1 is a partially cut-away isometric presentation of a specific embodiment of the invention. The figure shows a residential-style range hood 10 which is arranged to overlie, in this specific embodiment, a range 11 which has a cooking surface 12 and a plurality of burners 13.

Range hood 10 is provided, in this specific illustrative embodiment, with a top wall 20, side walls 21 (only one of which is shown in the figure), a front wall 22, and a back wall 23. This embodiment of the range hood also contains a filter housing 25 which is coupled to a duct outlet 26.

A chemical agent supply tank 30 is, in this specific embodiment, disposed on top of the range hood, illustratively on top wall 20, and is provided with a pressurized supply of fire suppressant material (not shown). The supply tank is coupled via a discharge valve 31 to a system of hoses 32 which couple the supply tank to a nozzle 33. Nozzle 31 is, in this specific illustrative embodiment of the invention, one of a plurality of nozzles. The discharge valve is maintained in a closed state by an operator lever 34 which is maintained in the position shown in the figure by operation of a wire 35 which is maintained in tension. An electrically actuated wire cutter 37 is arranged to surround wire 35. The wire cutter is provided with a pair of electrical leads 38 via which is supplied the electrical energy required to actuate the wire cutter. Upon actuation of wire cutter 37, as will be described hereinbelow, wire 35 is severed, permitting operator lever 34 to be urged upwardly, in this embodiment, by operation of a tension spring 36. The upward motion of the operator lever causes the discharge valve to be opened, thereby releasing the fire suppressant contents of the supply tank through hose 32, whereby it is expelled from nozzle 33. Nozzle 33, as shown, is directed to cooking range 11, so as to suppress a fire started thereon.

In operation, range hood 10 detects the presence of excessive heat thereunder, such as would be caused by a fire on cooking range 11, by means of a continuous sensor which is formed of a pair of twisted sensor wires 39. The twisted sensor wires are secured to the underside of the hood, illustratively one inch below the underside of top wall 20, or attached directly to the underside of top wall 20. In this embodiment, two sensor wires are employed (not specifically shown), and are placed from the rear of the hood toward the front wall. In one practicable embodiment, the sensor wires are placed approximately one inch from the side walls and parallel thereto. In addition, the wires are placed across the front of filter housing 25 at approximately one inch from the front thereof. The two sensor wires are coupled to connector wires which are coupled to a control panel (not shown in this figure) as will be described below.

As will be described hereinbelow, with respect to FIG. 2, a supervisory current is conducted through the twisted sensor wires and a termination impedance, which may be in the form of a sensor circuit, a lamp, such as a LED, or a termination resistor, as will be discussed herein. Each of the sensor wires in this embodiment is covered with a plastic insulation (not shown) which is characterized by a predetermined melting point. Thus, at the predetermined melting point, which may be 280° F. in some embodiments, the insulation melts so as to permit the wires to communicate electrically with one another. In one specific embodiment of the invention, twisted sensor wires 39 constitute a length of wire designated as type WPP wire rated at 280° F. Such wire is manufactured by Protectowire, Inc.

Figure 2:
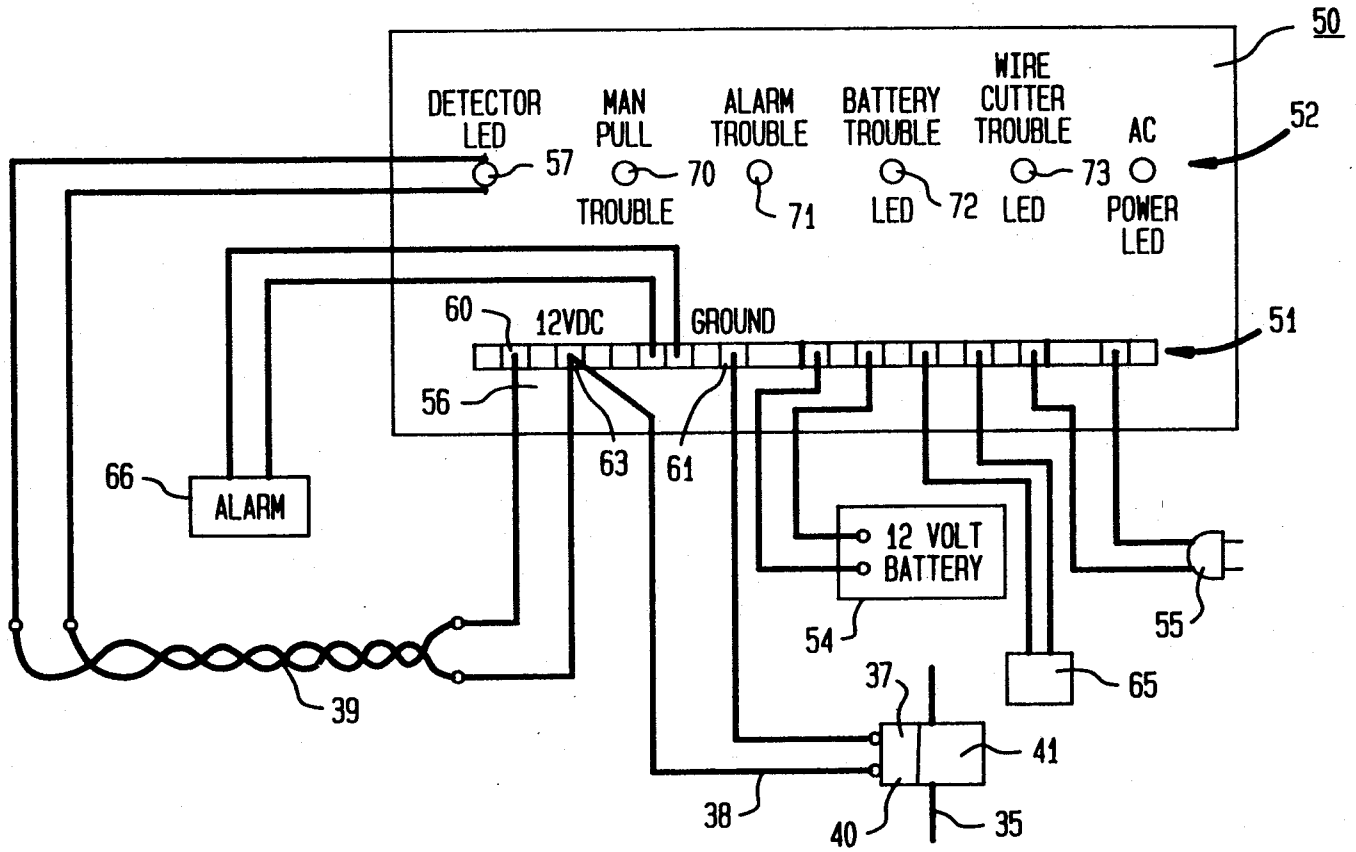
FIG. 2 is a schematic representation of a control panel with electrical inputs for various features of the invention.

FIG. 2 is a simplified schematic representation of a specific illustrative embodiment of an indicator and interconnection panel which is useful in the practice of a specific embodiment of the invention. Elements of structure which are identical or bear analogous correspondence to the elements of structure described hereinabove with respect to FIG. 1, are similarly designated. This figure shows a schematic representation of a panel 50 having a plurality of electrical terminals 51 associated therewith, and a plurality of indicator lights 52. Of course, in the practice of the invention, electrical terminals 51 need not necessarily be visible when a user of the system is observing indicator lights 52.

System power is obtained from a 12 volt direct current supply (not shown) which receives its power from the 120 volt mains at input 55. In this specific embodiment, the power supply will maintain the battery, illustratively 12 volt battery 54, in a charged state. The use of battery 54 provides the significant advantage of supplying power to the system during times that power from the mains (not shown) is unavailable. However, other embodiments of the invention might rely entirely on line power, without battery 54.

Electrical energy in the form of 12 volts DC is available at conductors 56, whereby the supervisory current described hereinabove is conducted through twisted sensor wires 39, and through a detector light emitting diode 57. In operation, the present specific illustrative embodiment employs a series electrical circuit which includes the twisted sensor wires, detector LED 57 and wire cutter 37. More specifically, 12 volts DC is available at terminal 60 with respect to ground at terminal 61. The current flows from terminal 60, through one of the twisted sensor wires 39, through detector LED 57, through the other of twisted sensor wires 39, to terminal 63, through lead 38, through wire cutter 37, and to ground at terminal 61. The current through this loop is controlled by the impedance of detector LED 57, which may have a series resistor associated therewith. The current is therefore limited to a level below the actuation level of wire cutter 37. Viewed another way, most of the voltage is dropped across detector LED 57 and its optional associated resistor (not shown), and only a small voltage is produced across the wire cutter. However, in the event of a thermal hazard sufficient to melt the plastic insulation surrounding the sensor wires, the sensor wires will communicate electrically with one another, effectively causing a low impedance condition which bypasses LED 57. Thus, a full 12 volts is applied across the wire cutter, which is then actuated to cut tension wire 35. In this embodiment, wire cutter 37 is of the type provided with an explosive portion 40 which, upon the application of the voltage across lead 38 and ground terminal 61, yields an explosion which urges a cutter portion 41 to sever the tension wire. As previously described, the cutting of the tension wire will permit the operator lever 34 to be moved such that discharge valve 31 is opened, releasing the fire suppressant fluid.

FIG. 2 further shows a remote manual electric release 65 which is useful to permit the system to be actuated from a remote location. In some embodiments, manual electrical release 65 may be a contact switch which is electrically coupled, by circuitry not shown, across terminals 60 and 63. Thus, this device serves to apply the full 12 volts to the wire cutter, thereby actuating same. In addition, also by means of circuitry which is not shown in this figure, an alarm 66 is actuated upon activation of the system for the purpose of providing a perceptible signal indicative of a fire. Alarm 66 may be in the form of a strobe light, a siren, or a horn. Persons of skill in the art would understand how to configure the circuitry which is mentioned herein, but not specifically disclosed. Such circuitry could include the circuitry which monitors the trouble indicators 70 to 73, which indicate failure conditions in the manual electric release 65, alarm 66, battery 54, and wire cutter 37, respectively.

Figure 3:
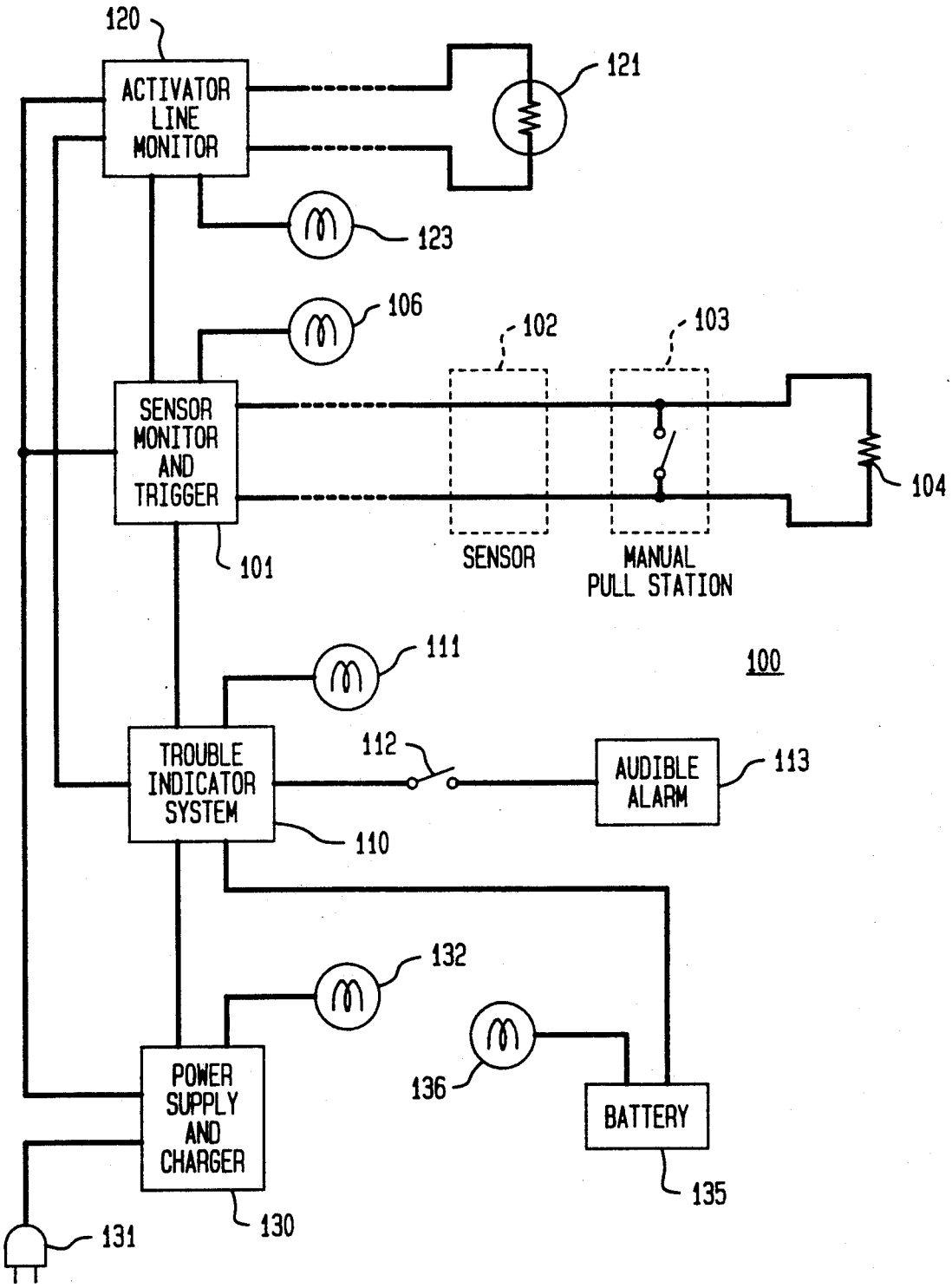
FIG. 3 is a function block representation of an illustrative system which controls the operation of a further illustrative embodiment of the invention.

FIG. 3 is a function block and line representation of a specific illustrative embodiment of a control system 100 which controls the operation of the fire extinguisher system of the present invention. As shown, control system 100 has a sensor monitor and trigger 101 which is coupled to sensor 102, manual pull station 103, and a termination resistor 104. Sensor 102, in this embodiment, correspond to sensor wires 39, described hereinabove with respect to FIG. 2. Manual pull station 103 is generally arranged at a location remote from the region to be protected from fire, such as cooking range 11 described hereinabove, and provides a means for actuating the system manually. In one simple embodiment of the invention, manual pull station 103 may comprise a switch across the sensor wires, which upon being closed, provides a short circuit across a terminating resistor 104.

In a preferred embodiment of the invention, sensor monitor and trigger 101 provides a supervisory electrical current through sensor 102, manual pull station 103, and terminating resistor 104 which is useful to determine whether the overall sensing system is operable. Thus, terminating resistor 104 should have a resistance value which is low enough to permit a requisite amount of current therethrough, but not so low as to appear as a short circuit to sensor monitor and trigger 101. Persons of skill in the art can configure an electrical monitoring arrangement which achieves the ends disclosed herein, without undue experimentation. In the event that sensor monitor and trigger 101 senses only little or insufficient supervisory current flowing through sensor 102, manual pull station 103, and terminating resistor 104, it will cause a visual indicator 106 to illuminate. The visual indicator may be in the form of a light-emitting diode.

In addition to the foregoing, the detection of insufficient supervisory current will cause sensor monitor and trigger 101 to issue a signal to a trouble indicator system 110 which will cause a trouble indicator 111 to illuminate. The trouble indicator system 110 is coupled via a switch 112 to an audible alarm 113. As described herein, trouble indicator system 110 provides via visual indicator 111 and audible alarm 113 notice to the user that the fire protection system is experiencing one or more of several forms of trouble, and may not be affording the desired degree to protection from a fire hazard.

FIG. 3 additionally shows an activator line monitor 120 which is coupled, in this specific illustrative embodiment of the invention, to a discharge actuator 121. In this embodiment, discharge actuator 121 is a known "squib" device which is a commercially available, powder activated apparatus. Thus, when activator line monitor 120 receives a triggering signal from sensor monitor and trigger 101, a pulse of current is conducted from the activator line monitor to the discharge actuator. This sets off a controlled explosive discharge which will cause the discharge of the fire suppressant material (not shown). For example, in an illustrative embodiment of the invention the energy of the explosive discharge is used to release the tension of wire 35 in FIG. 1, releasing the fire suppressant material as previously described.

In a preferred embodiment of the invention, activator line monitor 120 provides several additional functions which greatly increase the reliability of the overall system. For example, the activator line monitor can cause a supervisory current to flow through discharge actuator 121, in a magnitude below the actuation threshold. This will establish the continuity of the discharge actuator and its associated wiring. However, if the activator line monitor determines that the resistance of the actuation circuitry is too low, this would be indicative of a short-circuit condition which would impair the system's safety performance. Irrespective of the type of malfunction detected in the actuation circuitry, i.e., open circuit or short circuit, activator line monitor 120 will cause a visual indicator 123 to illuminate. In addition, the activator line monitor will issue a signal to trouble indicator system 110, which will cause indicator 111 to illuminate and optionally audible alarm 113 to sound.

Further with respect to FIG. 3, a power supply and charger 130 supplies the necessary electrical energy to the overall system from the electrical mains (not shown), via a standard plug 131. In the event that the voltage of the mains falls below a predetermined level, indicator 132 is illuminated, and a trouble signal is issued to trouble indicator system 110. The power supply and charge additionally provides a charging current to a battery 135 which is intended to maintain the fire protection notwithstanding the loss of main power. However, should the battery become defective or be in a discharged state, an indicator 136 will be illuminated and a trouble signal is issued to trouble indicator system 110.

As described herein, the system of FIG. 3 provides visual and audible indication of a number of fault conditions which might affect the ability of the fire extinguisher system to provide the desired degree of protection. It is a significant advantage of this system that, with the use of a powder-actuated fire suppressant release arrangement, as described herein, only small amounts of current are required to achieve the discharge, as opposed to the significantly larger current which would be required to actuate an electromechanical apparatus, such as a solenoid. Thus, a high degree of fire protection is maintained even though main power may have been disrupted for a considerable period of time, and the battery is partially discharged.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A system for protecting a predetermined region from a fire which may occur therein, the system comprising:

fire suppressant supply means for containing a quantity of pressurized fire suppressant material;

actuatable discharge means for releasing said quantity of pressurized fire suppressant material upon actuation of said actuatable discharge means;

sensor means arranged in the vicinity of the predetermined region, said sensor means having an electrical characteristic which changes in response to heat in the protected region, said sensor means having:

first and second conductors; a supervisory electrical current flowing through said first and second conductors;

conductor separation means having a predetermined heat response characteristic whereby said first and second conductors are maintained electrically insulated from one another below a predetermined temperature, and are brought into electrical communication with one another when said predetermined temperature is exceeded to produce a reduced electrical impedance characteristic across said first and second conductors and a corresponding increase in the magnitude of said supervisory electrical current;

sensor monitor means for monitoring said supervisory electrical current, and for signalling an increase in the magnitude thereof; and trigger means responsive to said signalling of said sensor monitor means for actuating said actuatable discharge means.

2. The system of claim 1, wherein said conductor separation means comprises an electrically insulating sleeve arranged to surround at least a portion of one of said first and second conductors, said electrically insulating sleeve being formed of a material which melts when said predetermined temperature is exceeded.

3. The system of claim 1 wherein there is further provided hood means arranged to overlie the protected region, said hood means having a top wall, first and second side walls, and a front wall, said first and second conductors being disposed substantially within said hood means.

4. The system of claim 1 wherein there is further provided discharge control means connected to said supply of fire suppressant material, for controlling a discharge of the fire suppressant material in response to the increase in the magnitude of the supervisory electric current.

5. The system of claim 4 wherein said actuatable discharge means comprises explosive means having an electrical input for receiving an electrical triggering pulse from said trigger means.

6. The system of claim 5 wherein said actuatable discharge means further comprises:

valve means having closed and open states;

operator means coupled to said valve means and having first and second positions which correspond to said closed and open states, respectively;

biasing means for applying a force to said operator means tending to urge said operator means to said second position;

a tension member coupled to said operator means for applying a force thereto in opposition to said biasing means and maintaining said operator means in said first position; and tension release means for releasing the force applied by said tension member in response to said explosive means.

7. The system of claim 6 wherein said tension release means comprises a cutter.

8. The system of claim 1 wherein there is further provided alarm means for providing a perceptible indication when a fault condition is detected in said actuatable discharge means.

9. The system of claim 8 wherein there is further provided battery back-up means for providing emergency power to the system.

10. The system of claim 9 wherein the system is arranged to receive electrical energy from a main electrical supply, and said battery back-up means further comprises:

charger monitor means coupled to said main electrical supply and said alarm means for providing a perceptible indication when a fault condition is detected in the electrical supply; and battery charge means coupled to said alarm means for providing a perceptible indication when a fault condition is detected in the charge state of said battery back-up means.

11. A system for producing an activation signal responsive to the presence of a fire which may occur within a predetermined region, the system comprising:

hood means arranged to overlie the protected region, said hood means having a top wall, first and second side walls, and a front wall;

first and second conductors for carrying a supervisory electrical current, said first and second conductors being arranged and supported beneath said hood means so as to be intermediate of said hood means and the protected region;

conductor separation means having a predetermined heat response characteristic whereby said first and second conductors are maintained electrically insulated from one another below a predetermined temperature, and are brought into electrical communication with one another when said predetermined temperature is exceeded to produce a substantially short-circuit condition across said first and second conductors and a corresponding increase in the magnitude of said supervisory electrical current;

sensor monitor means having inactivated and activated states responsive to an activation current threshold characteristic which is intermediate of a low supervisory electrical current value which flows through said first and second conductors, and a high supervisory electrical current value which flows through a low impedance condition produced when said first and second conductors are brought into electrical communications with one another, said sensor monitor means further having an electrical output for producing the activation signal in response to said activated state;

activator means for issuing an electric signal in response to said sensor monitor means; and activator monitor means for detecting a fault condition in said activator means.

12. The system of claim 11 wherein said conductor separation means comprises an electrical insulating material arranged to surround each of the first and second conductors, said conductors being twisted about one another for at least a portion of their respective lengths.

13. The system of claim 11 wherein there is further provided explosive actuator means responsive to said electric signal of said activator means for triggering a discharge of a fire suppressant material.

14. The system of claim 13 wherein there is further provided cutter means for effecting said discharge of said fire suppressant material in response to said explosive actuator means.

15. The system of claim 11 wherein said activator monitor means comprises:

activator short-circuit monitor means for detecting a short-circuit fault condition in said activator means; and activator open-circuit monitor means for detecting an open circuit fault condition in said activator means.

16. The system of claim 11 wherein there is further provided multi-condition fault indicator means for providing a perceptible indication responsive to said sensor monitor means and said activator monitor means.

17. A method of protecting a predetermined zone from a fire therein, the method comprising the steps of:

propagating a supervisory current through at least first and second conductors arranged in the vicinity of the predetermined region;

urging said first and second conductors into electrical communication with one another when a temperature within the predetermined region exceeds a predetermined temperature, whereby said first and second conductors achieve a low impedance condition;

monitoring the magnitude of a supervisory current flowing through said first and second conductors;

issuing an activation signal to an actuator in response to a change in the magnitude of the supervisory current; and triggering a discharge of a fire suppressant material in response to the activation signal.

18. The method of claim 17 wherein there is further provided the step of fault monitoring the actuator for detecting open-circuit and short-circuit faults therein.

19. The method of claim 17 wherein said step of triggering further comprises the step of igniting an explosive material in response to said activation signal.

* * * * *